US007668715B1

(12) United States Patent
Chaugule et al.

(10) Patent No.: US 7,668,715 B1
(45) Date of Patent: Feb. 23, 2010

(54) METHODS FOR SELECTING AN INITIAL QUANTIZATION STEP SIZE IN AUDIO ENCODERS AND SYSTEMS USING THE SAME

(75) Inventors: Ravindra Ramkrishna Chaugule, Pune (IN); Sachin P. Ghanekar, Pune (IN)

(73) Assignee: Cirrus Logic, Inc., Austin, TX (US)

( * ) Notice: Subject to any disclaimer, the term of this patent is extended or adjusted under 35 U.S.C. 154(b) by 1058 days.

(21) Appl. No.: 10/999,360

(22) Filed: Nov. 30, 2004

(51) Int. Cl.
*G10L 19/12* (2006.01)
*G10L 19/02* (2006.01)
*G10L 19/00* (2006.01)

(52) U.S. Cl. ..... 704/230; 704/222; 704/229

(58) Field of Classification Search ..... 704/222, 704/229–230
See application file for complete search history.

(56) References Cited

U.S. PATENT DOCUMENTS 4,191,858 A * 3/1980 Araseki ..... 704/224
5,054,073 A * 10/1991 Yazu ..... 704/230
5,303,346 A * 4/1994 Fesseler et al. ..... 704/230
5,913,186 A * 6/1999 Byrnes et al. ..... 704/204
5,930,750 A * 7/1999 Tsutsui ..... 704/229
6,011,554 A 1/2000 Grunbock et al.
6,029,126 A 2/2000 Malvar
6,058,362 A 5/2000 Malvar
6,115,689 A 9/2000 Malvar
6,138,090 A * 10/2000 Inoue ..... 704/212
6,182,034 B1 1/2001 Malvar
6,240,380 B1 5/2001 Malvar
6,253,165 B1 6/2001 Malvar
6,256,608 B1 7/2001 Malvar
6,307,549 B1 10/2001 Grunbock et al.
6,342,349 B1 1/2002 Virtanen
6,477,370 B1 11/2002 Siegler et al.
6,604,069 B1 * 8/2003 Tsutsui ..... 704/200.1
6,675,148 B2 1/2004 Hardwick
6,704,705 B1 3/2004 Azghandi et al.
6,748,363 B1 6/2004 Rowlands et al.
6,785,815 B1 8/2004 Bocon-Gibod
6,792,542 B1 9/2004 Atrero et al.
7,395,211 B2 * 7/2008 Watson et al. ..... 704/500

* cited by examiner

*Primary Examiner*—Richemond Dorvil
*Assistant Examiner*—Eric Yen
(74) *Attorney, Agent, or Firm*—Thompson & Knight LLP; James J. Murphy

(57) ABSTRACT

A method of performing quantization in an audio encoder includes determining a number of bits available in a frame of encoded audio data. Determinations are also made for the maximum transform coefficient value and a distribution of transform coefficient values across the transform coefficient spectrum being encoded. A an estimate for an initial quantization step value is determined from the number of available bits in the frame, the maximum transform coefficient value, and the distribution of coefficient values across the coefficient spectrum.

12 Claims, 4 Drawing Sheets

METHODS FOR SELECTING AN INITIAL QUANTIZATION STEP SIZE IN AUDIO ENCODERS AND SYSTEMS USING THE SAME

FIELD OF INVENTION

The present invention relates in general to audio compression techniques, and in particular, to methods for selecting an initial quantization step size in audio encoders and systems using the same.

BACKGROUND OF INVENTION

The popularity of small portable audio appliances and the ability to exchange audio information across the Internet have driven recent efforts to develop compression standards for storing, transferring, and playing back high fidelity audio information. Two of the more advanced of these audio compression standards are the Moving Pictures Expert Group Layer 3 (MP3) and the Advanced Audio Coding (AAC) standards.

Generally, the MP3 and AAC standards define audio decoding techniques that reduce the sampling rate and sample resolution of a stream of digitized audio data for storage and transmission. While these standards define a number of stream parameters, such as the input sampling rates and stream format, they otherwise allow significant flexibility in the implementation of the actual encoders and decoders.

In designing MP3 and AAC audio encoders and decoders, efficient encoding and decoding techniques are required for compressing high-fidelity audio into the smallest possible compressed digital files and subsequently reconstructing that high-fidelity audio from the compressed digital files without significant noise and distortion. Further, these audio techniques should minimize the overall complexity of the hardware and software designs, while at the same time being sufficiently flexible for utilization in a range of possible applications.

SUMMARY OF INVENTION

The principles of the present invention are embodied in methods for efficiently selecting the initial quantization value during audio encoding operations. According to a particular representative embodiment, a method is disclosed for performing quantization in an audio encoder and includes determining a number of bits available in a frame of encoded audio data. Determinations are also made for the maximum transform coefficient value and a distribution of transform coefficient values across a transform coefficient spectrum being encoded. A quantization step value is determined from the number of available bits in the frame, the maximum transfer coefficient value, and the distribution of coefficient values across the transform spectrum.

Embodiments of the present principles advantageously increase the efficiency of audio encoding processes, by reducing the amount of time required for a quantization process to converge. These principles are applicable to both single-loop and dual-loop encoding processes utilized, for example, in MP3 and AAC audio encoding, in which the number of loop iterations is reduced thereby increasing the efficiency of the encoding process. Additionally, the principles of the present invention also account for the distribution of MDCT coefficient levels and the dynamic range of the input signal, which increases the efficiency of the associated Huffman encoding scheme.

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
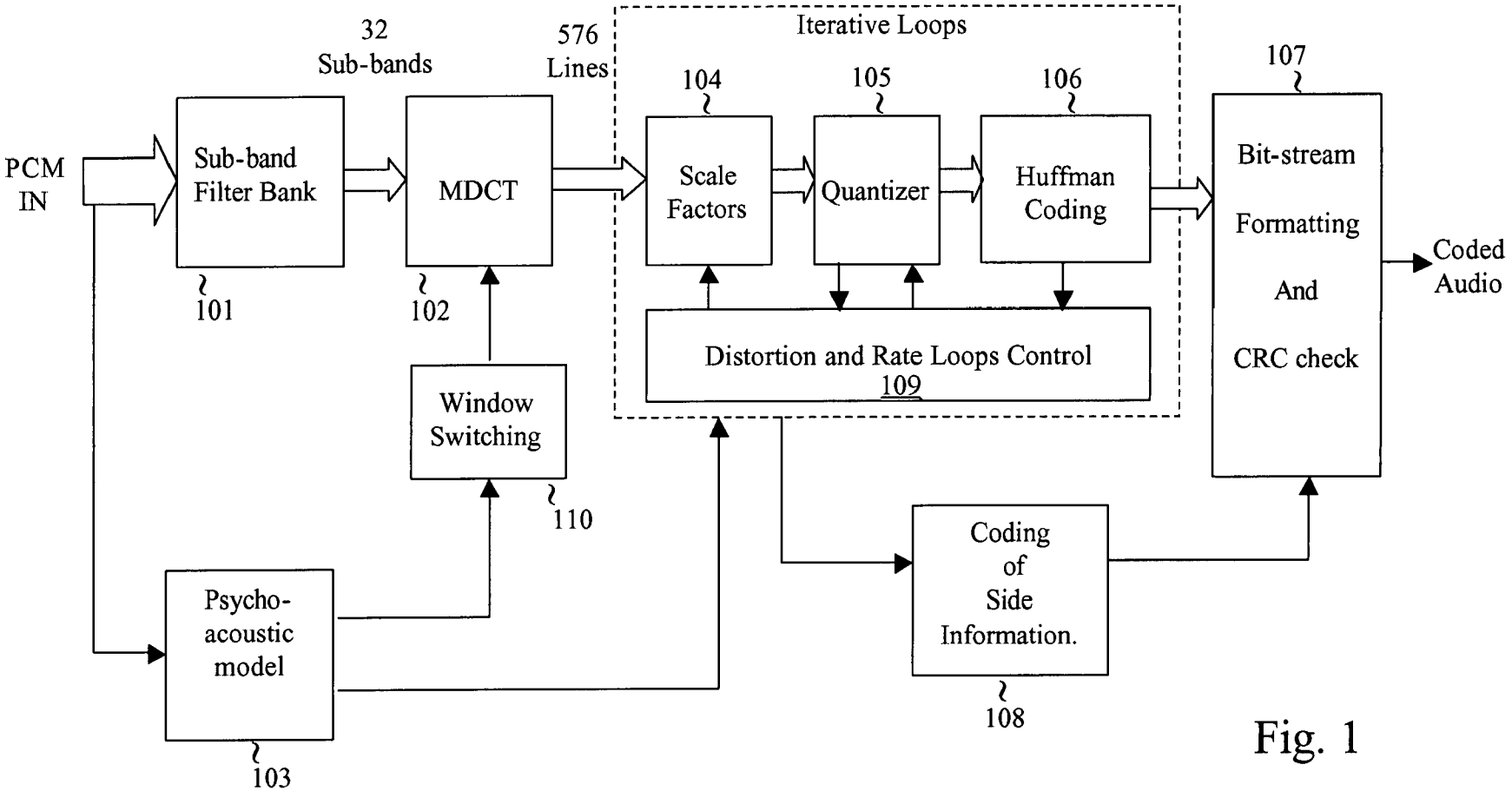
FIG. 1 is a high level block diagram of a typical MP3 audio encoder suitable for describing the present inventive principles.
Figure 2:
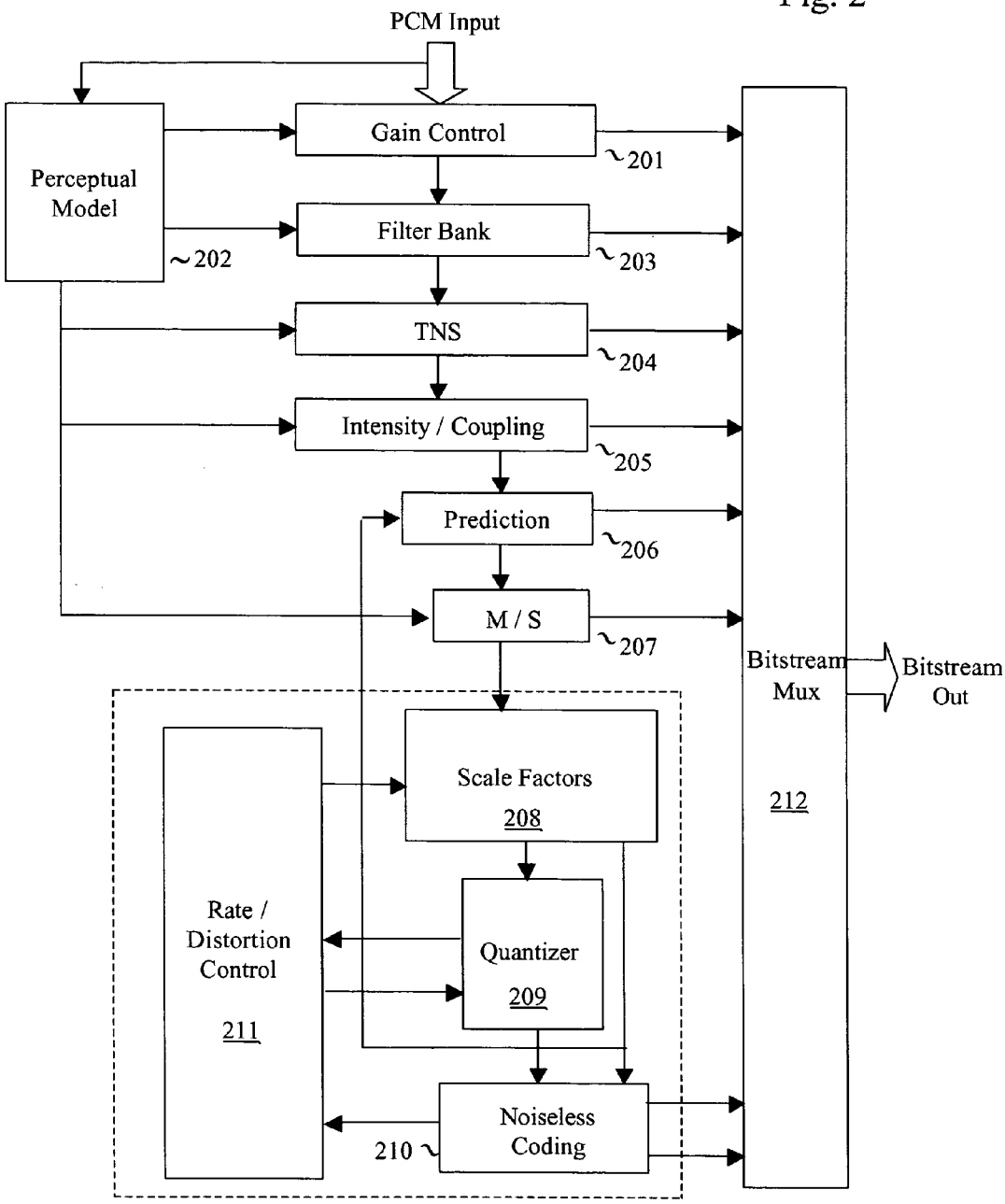
FIG. 2 is a high level block diagram of a typical dual loop AAC audio encoder suitable for describing the present inventive principles.
Figure 3A:
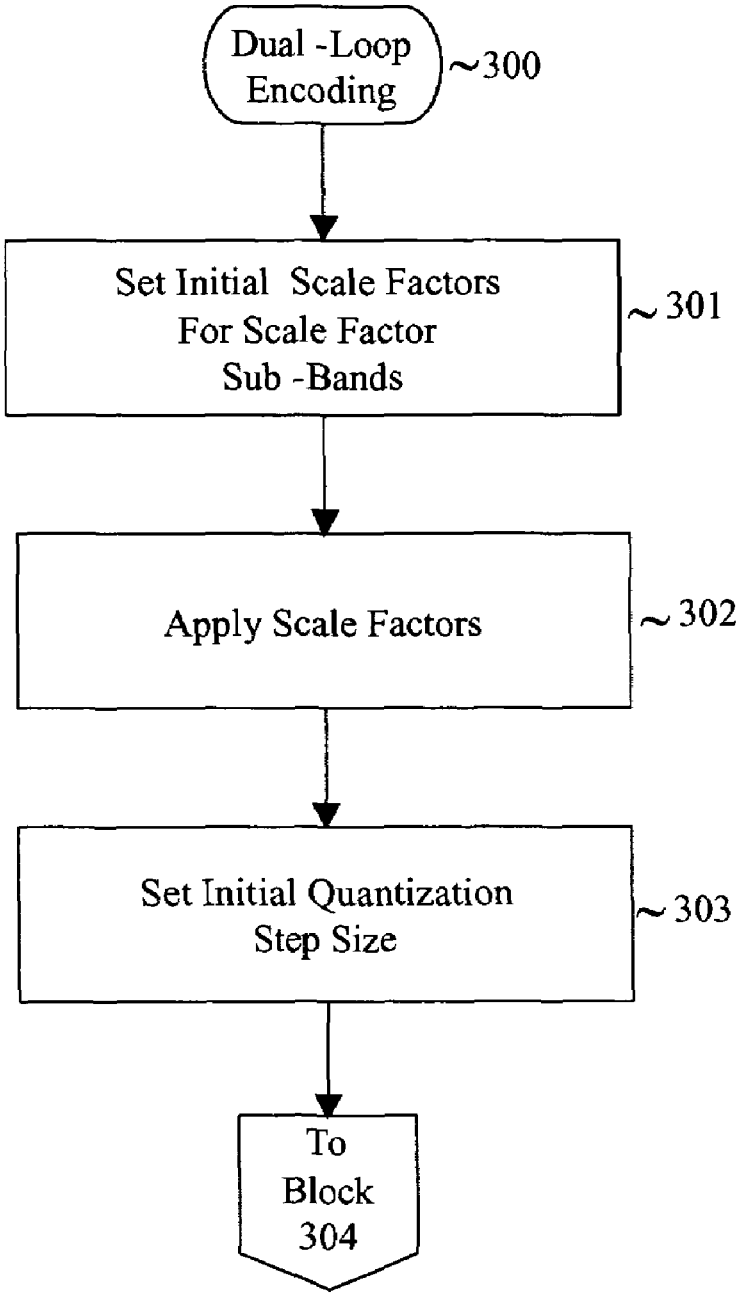
FIG. 3 is a flow chart illustrating a representative rate-distortion control process embodying the principles of the present invention and suitable, for example, in the audio encoders shown in FIGS. 1 and 2.
Figure 3B:
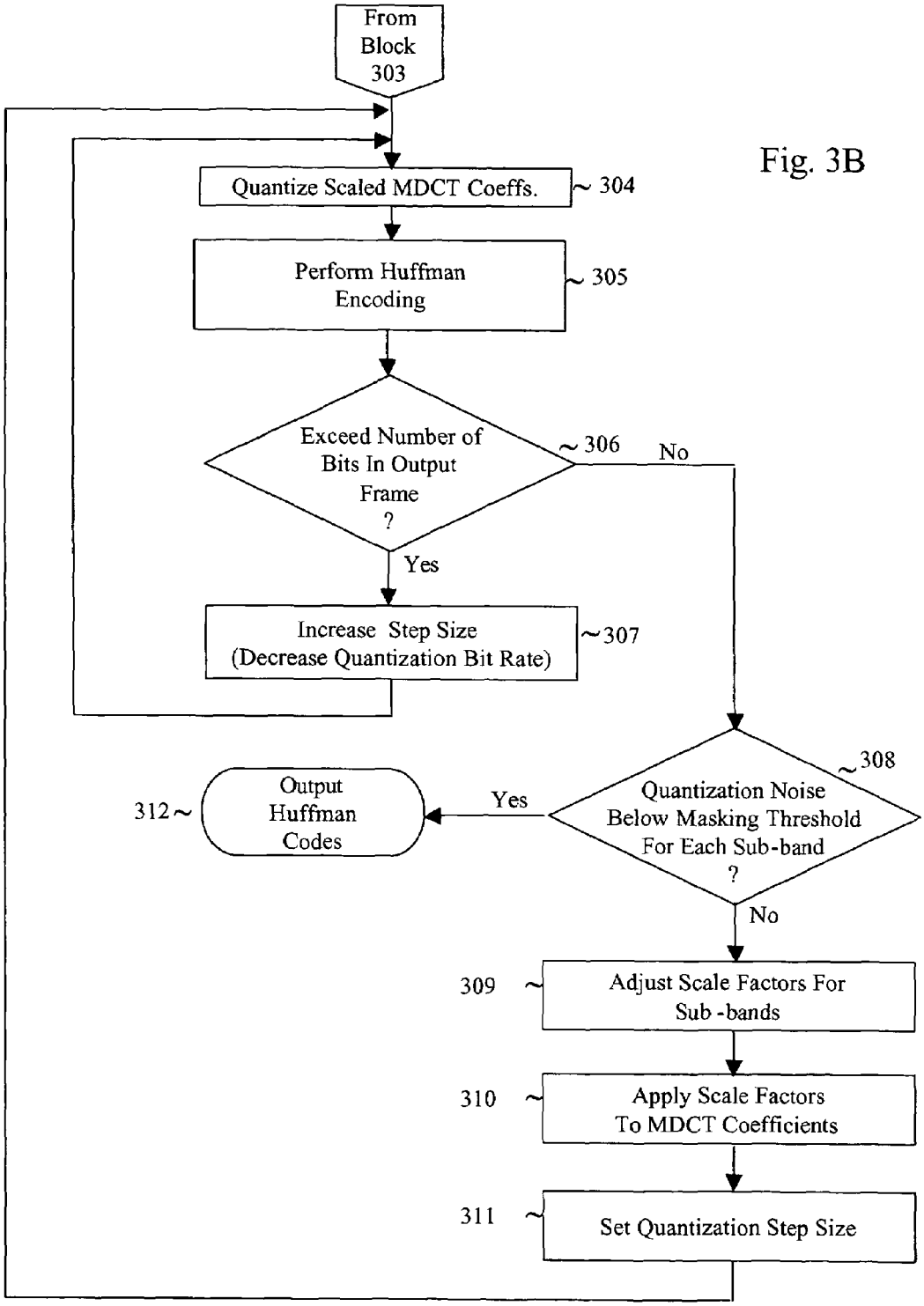

The principles of the present invention and their advantages are best understood by referring to the illustrated embodiment depicted in FIGS. 1-3 of the drawings, in which like numbers designate like parts.

FIG. 1 is a block diagram illustrating an exemplary MP3 audio encoder 100 suitable for describing the principles of the present invention. MP3 audio encoder 100 is implemented, for example, on a digital signal processor (DSP), or similar hardware-software platform. As shown in FIG. 1, a set of sub-band filters 101 divides the frequency spectrum of the incoming digital audio data stream PCM IN into thirty-two (32) frequency sub-bands. Modified Discrete Cosine Transform (MDCT) filters 102 further divide the sub-bands in the frequency domain to generate five hundred and seventy six (576) frequency domain coefficients with increased frequency spectral resolution.

At the same time, a psycho-acoustic model 103 is applied to the input audio data stream PCM IN, which determines the noise masking available for each signal component in the audio input stream based on frequency and loudness. Generally, noise masking takes advantage of the inability of the human auditory system to perceive weaker audio signals in the spectral or temporal neighborhood of stronger audio signals. Additionally, psycho-acoustic model 103 takes into account the limits on the frequency resolution of the human auditory system that result in blurring of signal components across critical signal bands. In other words, psycho-acoustic model 103 defines a noise-masking threshold for a given frequency component of the audio input signal based on the signal energy within a frequency band in the neighborhood of that frequency component.

Psycho-acoustic model 103 also controls MDCT filters 103. Generally, each of the thirty-two (32) streams of data samples from the corresponding sub-band filter 101 is operated on in overlapping blocks defined by temporal windows or a transient detection algorithm controlled by psycho-acoustic model 103 through window control block 110.

The MDCT coefficients output from MDCT filters 103 are scaled in scale factor block 104 with scale factors based on the masking thresholds determined by psycho-acoustic model 103. In particular, the scale factors are applied to scale-factor bands covering multiple MDCT coefficients, and which approximate the critical auditory bands. After scaling, the MDCT coefficients are companded by a factor of $X^{3/4}$ to balance the signal-to-noise ratio and then quantized in quantizer 105. The integer parts of the resulting quantized values index Huffman code tables 106 to produce the encoded audio output stream. A formatter 107 formats the encoded data into output frames, including headers, the scale factors, other side information generated by side information block 108, and the actual encoded audio samples. A cyclic redundancy check (CRC) is also performed on the compressed output stream.

In typical MP3 encoders, a dual-loop process is often utilized during quantizing and encoding of the MDCT coefficients. In this process, an inner loop adjusts the quantization step size and selects the Huffman code tables. Huffman encoding assigns shorter code words for smaller quantized MDCT coefficients. Hence, if the number of Huffman-encoded bits generated for a corresponding output data frame is above or below the number of bits allocated for that frame, the inner loop iteratively adjusts the quantization steps to best fit the encoded bits into that output frame. The outer loop observes the noise in each scale-factor band and adjusts the corresponding scale-factor until the quantization noise is below the masking threshold generated by the psycho-acoustic model. The inner loop re-adjusts the quantization step size with each iteration of the outer loop in nested-loop operations.

The controlling inputs to the rate/distortion control module include the number of bits available for encoding a given MDCT spectrum, as governed by the desired bit rate of the encoded stream, and the masking threshold calculated by the psycho-acoustic model. Given these two inputs, the rate control/distortion module attempts to shape the quantization noise below the masking curve by adjusting the scale-factors. At the same time, the rate/distortion control module utilizes the global quantization step-size such that the number of bits utilized for encoding is very close to the number of available bits for encoding the given MDCT spectrum.

Current implementations of the inner loop typically do not minimize the number of iterations required to converge to the optimal quantization step value. This deficiency directly and adversely impacts the speed and efficiency of the over all audio encoding process. This problem is advantageously addressed by the principles of the present invention in distortion and rate Loops control block 109, as discussed in detail below.

A similar two-loop iterative quantization and coding procedure is utilized in typical AAC encoders, such as the ACC encoder 200 shown in FIG. 2. In AAC encoder 200, the incoming data stream PCM IN is first passed through gain control 201 under the control of perceptual (psycho-acoustic) model block 202. Next, the data stream PCM IN goes directly to an MDCT filter bank 203 and converted into one thousand twenty-four (1024) lines of frequency domain coefficients. Temporal noise shaping (TNS) block 204 then performs time-domain noise shaping by performing open loop prediction in the frequency domain.

Intensity/coupling block 205 performs intensity stereo processing and coupling operations, which generally allow two channels of stereo audio data to be jointly encoded to increase compression efficiency. Prediction block 206 performs backward prediction, on a line-by-line basis, for encoding tone-like signals. Mid/side encoding block 207 coding generally generates an average between two channels of stereo audio data, to further increase the efficiency of the encoding process.

Exemplary AAC encoder 200 includes a scale factors block 208, which applies scale factors to scale bands, as determined by the psycho-acoustic model, a quantizer 209, and a noiseless encoding block 210, which performs Huffman encoding on the data stream. In the illustrated embodiment, a dual-loop process, similar to the MP3 example discussed above, utilized by rate/distortion control block 211 for quantization and coding. Bitstream multiplexer (MUX) 212 generates the formatted compressed output data stream.

According to the principles of the present invention, rate/distortion loop control block 109 of FIG. 1 and rate/distortion control block 210 of FIG. 2 provide for faster inner loop convergence. In particular, the principles of the present invention are embodied in methods that allow the initial quantization step size, utilized in quantizer 105 of FIG. 1 and quantizer 209 of FIG. 2, to be more precisely calculated. In turn, the number of inner loop iterations is reduced thereby increasing the efficiency of the encoding process. Additionally, the principles of the present invention also account for the distribution of MDCT coefficient levels and the dynamic range of the input signal, which increases the efficiency of the audio encoding scheme.

FIG. 3 is a flow chart illustrating an exemplary audio dual-loop decoding procedure 300, suitable for describing the principles of the present invention. While these principles are illustrated with a dual-loop process as an example, the present inventive principles are applicable to other quantization processes, including other audio quantization processes.

At block 301, a set of initial scale factors is set for the scale factor sub-bands. These scale factors are applied at block 302 and an initial quantization step size if set at block 303.

At blocks 304 and 305, the scaled MDCT coefficients are quantized and Huffman decoded. If the number of bits resulting from Huffman encoding exceeds the number of bits available in the current output frame, then the quantization step size is increased at block 307 to decrease the quantization bit rate. Procedure 300 then loops back to quantization block 304 and the process repeats.

On the other hand, if the number of bits generated during Huffman decoding is less than the number allocated to the output frame, then at block 308 a determination is made as to whether the quantization noise is below the masking threshold for each sub-band. If the quantization noise is below the corresponding masking threshold, procedure 300 ends at block 312 with the output of the generated Huffman codes for the current output frame.

If, at block 308, the quantization noise is not below the masking threshold for each sub-band, the scale factors for all sub-bands are adjusted at block 309 and applied to the corresponding MDCT coefficients at block 310. At block 311, the quantization step size is reset and procedure 300 loops-back to quantization block 304 and repeats.

A set of equations, described in detail below, provides a "best guess" for the initial quantization-step-size based on statistically and empirically observed behavior of various audio test vectors in response to different quantization step initialization step-sizes. Generally, these equations are based on the following observations. First, quantization step-size is directly proportional to available number of bits in the current output frame. Second, quantization step-size is related to the maximum value of the current MDCT output coefficient spectrum. Third, quantization step-size depends on the distribution of each MDCT coefficient value with respect to the maximum MDCT coefficient value. This third factor is important since it reflects the compression efficiency of the Huffman encoding operation and the corresponding improvement in compression gain over linear encoding.

Specifically, if the maximum MDCT coefficient value is high, then the dynamic range of all the MDCT coefficient values to be encoded is large and hence the number of bits required during encoding is large. The choice of optimal step size must therefore be varied accordingly. Further, the number of bits used during encoding also depends on the distribution of MDCT coefficient values between MDCT lines 0 to MDCT max (575 for MP3 and 1023 for AAC). Again, a similar correction must be applied to the optimal quantization step-size. For example, if the MDCT coefficients are densely distributed near the low amplitude region, excellent Huffman coding gain is achieved and the number of bits required during encoding is reduced. On the other hand, if the MDCT coefficients are more or less evenly distributed in all amplitude regions, the Huffman coding gain is reduced, and the number of bits required during encoding substantially increases.

Generally, the optimal quantization step size is the one for which the number of bits required during encoding is slightly less than available bits in the current output frame. In sum, the equations embodying the principles of the present inventive principles are based on the following considerations: (1) the number of bits available in the current output frame; (2) the maximum absolute MDCT coefficient value in the current MDCT coefficient spectrum; and (3) the distribution of the MDCT coefficient values across the MDCT spectrum.

According to the principles of the present invention, the best guess initial quantization step-size for the dual-loop MP3 encoding process is given by Equation (1):

$$\text{Optimal_quant_step_size}=C+(16/3*\log_2\text{Max_Abs_MDCT})+(\text{bits available}/(108*f) \quad (1)$$

in which, C depends upon the distribution of absolute values of companded MDCT coefficients, Max_Abs_MDCT is the maximum MDCT coefficient value in the companded spectrum, and f represents Huffman compression coding gain with fixed length encoding.

Code in the C programming language for implementing Equation (1) is provided in Appendix A for reference.

According to the principles of the present invention, the best guess initial quantization step-size for the dual-loop AAC encoding process is given by Equation (2):

$$\text{Optimal_quant_step_size}=C+(16/3*\log_2\text{Max_Abs_MDCT})-(\text{bits available}/(192*f) \quad (2)$$

in which, C depends upon the distribution of absolute values of companded MDCT coefficients, Max_Abs_MDCT is the maximum MDCT coefficient value in the companded spectrum, and f represents Huffman compression coding gain with fixed length encoding.

Code in the C programming language for implementing Equation (2) is provided in Appendix B for reference.

Equations (1) and (2) are general form equations embodying the principles of the present invention derived based on the following analysis and empirical observation. For MP3 encoding, due to the definitions in the standard, increasing the quantization step-size quant_step_size increases the number of bits required during encoding, while for AAC encoding decreasing the step-size quant_step_size increases the number of bits required during encoding.

In linear quantization, the number of bits required is given by Equation (3) in which the value max (mdct levels[i]) is the maximum MDCT coefficient value in the MDCT coefficient after psycho-acoustic scaling, companding, and applying the global quantization step. For MP3, N=576, and for AAC, N=1024.

$$\text{Bits_used}=\log_2|\max_(\text{mdct_levels}[i])| \quad (3)$$

MP3 and AAC encoders both utilize Huffman coding for variable length encoding. If the Huffman coding gain is "f1", and the MDCT coefficient values fall in the range of Huffman code-book tables, in the illustrated embodiment, for max_mdct<16, then:

$$\text{Bits_used}=(f1*N*\log_2\max(\text{abs_mdct}[i]))+\text{min_audio_data_bits}, \quad (4)$$

in which min_audio_data_bits frame is the number of bits required to encode an all zero (0) output frame.

For max_mdct>16, the escape codes, described below, are applied and the number of bit required becomes:

$$\text{Bits_used}==\text{Nlarge}*f2*\log_2\max(\text{abs_mdct}[i])+f1*(N-\text{Nlarge})*\log_2 16+\text{min_audio_data_bits}, \quad (5)$$

in which the value Nlarge is the number of the MDCT values that have absolute values larger than sixteen (16) and f2 refers to the coding gain for encoding MDCT values beyond sixteen (16).

If N>>Nlarge, then:

$$\text{Bits_used}\approx\text{Nlarge}*f2*\log_2\max(\text{abs_mdct}[i])+\text{audio_data_bits_used_16}, \quad (6)$$

in which the value audio_bits_used_16 is the number of audio bits required for encoding the MDCT coefficient spectrum after scaling such that maximum of the MDCT coefficients is sixteen (16).

An observation of the variation of Bits_used based on changes in the quantization step size provides for estimation of a best guess optimal step size. For example, one estimate for the value of Bits_used if the quantization step size is varied by small Δq change in the MDCT coefficient spectrum is:

$$\text{abs}(\text{mdct_spectrum_new}(i))=\text{abs}(m(i))*2^{(-3/16*\Delta q)} \quad (7)$$

in which m[i] is the value of the MDCT coefficients of the original MDCT coefficient spectrum. The scaled MDCT coefficient spectrum from quant_step is thus:

$$\text{abs}(\text{mdct}(i))=\text{abs}(\text{mdct_orig}(i))*2^{(-3/16*quant_step)}*\log_2\max(\text{abs}(\text{mdct}[i]))=\log_2\max(\text{abs}(\text{mdct_orig}[i]))-3*\text{quant_step}/16 \quad (8)$$

An estimate the number of bits is then estimated from the bilinear equation forms:

$$\text{Bits_used}=c1+Nf1*(-3/16*\text{quant_step}+\log 2(\text{max_abs_mdct}))(\text{for max scaled mdct}<16);\ \text{and} \quad (9)$$

$$\text{Bits_used}=c2+Nf2*(-3/16*\text{quant_step}+\log 2(\text{max_abs_mdct}))(\text{for max of scaled mdct}>=16) \quad (10)$$

The parameter pairs (C1, Nf1) and (C2, Nf2) depend on the overall scaling factor of the original MDCT coefficient spectrum specific to implementation of the MDCT module. One of the parameter pairs (C1, Nf1) and (C2, Nf2) is selected depending on whether the maximum of the MDCT coefficients scaled using quant_step is below or above sixteen (16) (i.e. the knee point). The distribution of the MDCT coefficient values determines the encoding efficiency and hence also decides the values for intercept and slope for (C1, Nf1) pair. The analysis is simplified by setting:

$$\text{max_step}=16/3*\log_2\text{max_abs_mdct}. \quad (11)$$

For an audio encoder, the reverse analysis is performed. In other words, given the number of bits available for encoding one output frame, an optimal quantization step size is estimated. In particular, the optimal quantization step size for the given MDCT coefficient spectrum is estimated when the actual bits used, after scaling the MDCT coefficients by the value quant_step and Huffman encoding, is approximately equal to the number of bits available in the output frame.

Approximations for the number of bits used are defined by Equations (12) and (13):

$$\text{Bits_Available} \approx \text{Bits_used for max scaled mdct}<16 = C + Nf1 \cdot (-3/16 * \text{optimal_quant_step} + \log 2(\text{max_mdct})) = C1 + 3/16 * Nf1 * (-\text{optimal_quant_step} + \text{max_step}) \quad (12)$$

$$\text{Bits_Available} \approx \text{Bits_used for max scaled mdct}>16 = C2 + 3/16 \cdot Nf2 * (-\text{optimal_quant_step} + \text{max_step}) \quad (13)$$

Again, the values of (C and Nf) are dependent on the distribution of MDCT coefficient values. Therefore, an optimal_quant_step_size estimation from Bits_available is:

$$\text{Optimal_quant_step_size} = \text{max_step} - Kf1 - \text{Bits_Available}/f1(\text{for max scaled MDCT}<16) \quad (14)$$

$$\text{Optimal_quant_step_size} = \text{max_step} - Kf2 - \text{Bits_Available}/f2(\text{for max scaled MDCT}>=16) \quad (15)$$

Both MP3 and AAC encoders utilize separate Huffman tables designed for maximum quantized values in the range of 0 to 15. Separate Huffman tables and an escape code mechanism are provided for maximum quantized values beyond 15. Specifically, if the quantized value is above 15, that value is linearly encoded. Once a maximum quantized value in the scaled MDCT coefficient spectrum goes beyond 16, the Huffman encoding gain is generally less. Therefore, the value of "f" correspondingly changes and introduces a knee point in the linear approximation equations.

Different values of c1 and f differ before and after the knee point. The knee point is the point where the maximum quantized values just start falling into the escape Huffman coding region (i.e. max_MDCT=16). A first approximation of the knee point is:

$$\text{Available_bits_knee} = (\text{no_of_bins}) \cdot \text{Avg number of bits per bin for max_MDCT} = (\text{no_of_bins}) \cdot \log_2(16) \cdot (1/\text{Huffman coding gain}) \quad (16)$$

For MP3, the observed Huffman coding gain for music files is $1/0.34$ and no_of_bins is 576, resulting in a value of available_bits_knee of 800. For AAC, the observed Huffman coding gain for music files is $1/0.24$ and no_of_bins is 1024, resulting in a value of available_bits_knee of 1000.

If bits_used at the knee point is Usedbits_knee. Then Equations (14) and (15) can be written as:

$$\text{Optimal_quant step_size} = \text{max_step} - Kf1 - \text{Bits_Available}/Gf1(\text{Bits_available}<\text{Usedbits_knee}) \quad (17)$$

$$\text{Optimal_quant_step_size} = \text{max_step} - Kf2 - \text{Bits_Available}/Gf2(\text{Bits available}>=\text{Usedbits knee}) \quad (18)$$

Plotting the value of max_step_optimal_quant_step versus bits_available, reveals that for a given value of bits_available, the mean value of max_step-optimal_quant_size demonstrates distinct bilinear behavior with a knee point. Different audio signals show completely bilinear behavior with completely different intercepts and slopes; however, the knee point remains the same. The procedures provided as Appendices A and B empirically provide the best convergence properties (i.e. best estimate of optimal_quant_step_size for the number available bits). In Appendices A and B the value meanbymax of the MDCT coefficient set is a first order parameter to describe the distribution of MDCT values, which determines the set of values (Kf1, Gf1) and (Kf2, Gf2) need in the above equations.

The value meanbymax is a first order approximation providing an objective measure of the distribution of the MDCT coefficients:

$$\text{meanbymax} = \text{mean_abs_MDCT_values}/\text{max_abs_MDCT_values} \quad (19)$$

Generally the value meanbymax is a very effective for partitioning the above equations into separate regions having different c1 and f1 values.

Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore contemplated that the claims will cover any such modifications or embodiments that fall within the true scope of the invention.

APPENDIX A

Equations used in C implementations of mp3__encoder.

```
In these equations,
g__part3__available -> bits __ available
max__step -> 23 *4- 4*log2 (max__abs__mdc)
meanbymax -> mean__abs__mdct__value / max__abs__mdct
g__init__quant -> Optimal__ Q__step__size
if(g__part3__available < 800) {
    if(meanbymax < 0.015)
        g__init__quant = max__step -35 + (0.035 * (g__ part3__available)); // 1/f= 3.78;f
= 0.26
else if ((meanbymax > 0.0150) &&(meanbymax < 0.04))
    g__init__quant = max__step -59 + (0.025 * (g__part3__available));
else if((meanbymax > 0.04)&&(meanbymax < 0.06))
    g__init__quant = max__step -61 + (0.0185 * (g__part3__available));
else
    g__init__quant =max__step - 67 + (0.014* (g__part3__available));
}
else
{
if(meanbymax < 0.0150)
    g__init__quant = max__step -8 + (0.000508* (g__part3__available));
else if ((meanbymax > 0.0150) &&(meanbymax < 0.04))
```

APPENDIX A-continued

Equations used in C implementations of mp3_encoder.

```
    g_init_quant = max_step -48 + (0.010*(g_part3_available));
else if((meanbymax > 0.04)&&(meanbymax < 0.06))
    g_init_quant = max_step - 52 + (0.0115 * (g_part3_available));
else
g_init_quant = max_step -64 + (0.009* (g_part3_available));
}
```

In the above procedure, the variable usedbits _ knee for mp3encoder was found to be 800 by generating plots for different audio signals.

APPENDIX B

Equations used in C implementations in AAC Encoder.

```
// In these equations,
// available_block_bits -> bits_available
// start_com_sf      -> Optimal_Q_step_size
// max_step = 16/3 * (log(ABS(pow(max_dct line, I.0)/MAX_QUANT))/log(2.0))
if ((mean/max_dct_line) < 0.005)
}
    if ( available_ block_bits < 1000)
    start_com_sf = (int) (20+ (max_step) - 0.03 *(available_block_bits));
    else
    start_com_sf = (int) (-10 + (max_step) - 0.0002*(available_block_bits));
}
else if (((mean/max dct line) > 0.005) && ((mean/max_dct_line) < 0.02))
{
    //bach, trumpet, mozart // dualspeech, castanets
    if( available_block_bits < 1000)
    start_com_sf = (int)(45 + (max_step) -.017 *(available_ block bits));
else
    start_com_sf = (int)(32 + (max_step) -.007*(available_block_bits));
}
else if (((mean/max_dct_line) > 0.02) && ((mean/max_dct_line) < 0.04))
{
    // bothsidesnow,pop // cast27
    if (available_block_bits < 1000)
        start_com_sf = (int)(50 + (max_step) -.014*(available_block_bits));
    else
        start_com_sf = (int)(40 + (max_step) -.007*(available_block_bits));
else
{
    if ( available_block_bits < 1000)
        start_com_sf = (int)(50 + (max_step) -.005*(available_block_bits));
else
        start_com_sf = (int)(45 + (max_step) -.005*(available_ block_bits));
}
```

usedbits_knee for AACencoder was found to be 1000 by looking at plots for different audio signals.

What is claimed:

1. A method of performing quantization in an audio encoder comprising:

in an audio encoder determining a number of bits available in a frame of encoded audio data;

determining the maximum transform coefficient value from a transform coefficient transform spectrum being encoded;

determining if the number of bits available for encoding a frame of audio data is above or below a knee point;

determining a coding gain factor from the determination of whether the number of bits are available for encoding a frame of audio data is above or below the knee point;

determining a distribution of transform coefficient values across the transform coefficient spectrum being encoded by calculating a ratio value from a ratio of a mean transform coefficient absolute value of a transform coefficient spectrum to a maximum transform coefficient absolute value of the transform coefficient spectrum;

calculating a parameter value from the distribution of transform coefficient values across the transform coefficient spectrum;

calculating another ratio value from the number of available bits and the number of coefficients in the transform coefficient spectrum factored by the coding gain; and determining a quantization step size from the parameter value, the another ratio value, and the maximum coefficient value of the transform coefficient spectrum; and quantizing a stream of audio data with the audio decoder utilizing the determined quantization step size.

2. The method of claim 1, wherein calculating the parameter value comprises calculating a sum of the logarithms of ratios of absolute values of the transform coefficients to an absolute value of the maximum transform coefficient.

3. The method of claim 1, wherein determining a coding gain factor is based on transform first order statistics.

4. The method of claim 1, wherein determining a quantization step value comprises adding the parameter value, a logarithm of an absolute value of the maximum transform coefficient value, and the another ratio value.

5. The method of claim 1, wherein determining a quantization step value comprises subtracting a logarithm of an absolute value of the maximum transform coefficient value from the parameter value, and combined with the another ratio value.

6. The method of claim 1, further comprising empirically determining the knee point.

7. The method of claim 1, further comprising initiating encoding of the transform coefficients with the determined quantization step size to generate encoded data in accordance with Moving Pictures Expert Group 2, Layer 3 audio data encoding standard.

8. The method of claim 1, further comprising initiating encoding of the transform coefficients with the determined quantization step size to generate encoded data in accordance with the Advanced Audio Coding standard.

9. A method of determining a quantization step size for quantizing transform coefficients during encoding of audio data comprising:

in an audio encoder;

determining if the number of available number of bits for encoding a frame of audio data is above or below a knee point;

calculating a parameter value from a ratio of a mean transform coefficient absolute value of a transform coefficient spectrum to a maximum transform coefficient absolute value of the transform coefficient spectrum;

determining a coding gain factor from in response to determining whether the number of available bits for encoding the frame of audio data is above or below the knee point;

calculating another ratio value from of the number of available bits and a number of coefficients in the transform coefficient spectrum factored by the coding gain;

determining a quantization step size from the parameter value, the another ratio value, and the maximum coefficient value of the transform coefficient spectrum; and quantizing transform coefficients, generated from a stream of audio date, utilizing the determined quantization step size.

10. The method of claim 9 utilized during encoding of data in a dual-loop audio data encoding process.

11. The method of claim 9 utilized during encoding of Moving Pictures Expert Group Layer 3 audio data.

12. The method of claim 9 utilized during encoding of Advanced Audio Coding audio data.

* * * * *